US010167715B2

(12) United States Patent
Rashid et al.

(10) Patent No.: US 10,167,715 B2
(45) Date of Patent: Jan. 1, 2019

(54) BUILDUP AND ENCAPSULATION OF ANTENNA SECTION OF DOWNHOLE TOOL

(71) Applicant: Halliburton Energy Services, Inc., Houston, TX (US)

(72) Inventors: Kazi M. Rashid, Spring, TX (US); Michael J. Levchak, Tomball, TX (US); Alexei Korovin, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 87 days.

(21) Appl. No.: 15/022,080

(22) PCT Filed: Oct. 20, 2015

(86) PCT No.: PCT/US2015/056475

§ 371 (c)(1),
(2) Date: Mar. 15, 2016

(87) PCT Pub. No.: WO2017/069744

PCT Pub. Date: Apr. 27, 2017

(65) Prior Publication Data

US 2017/0260845 A1 Sep. 14, 2017

(51) Int. Cl.

| | |
|---|---|
| ***E21B 47/12*** | (2012.01) |
| ***E21B 47/01*** | (2012.01) |
| ***E21B 49/00*** | (2006.01) |

(52) U.S. Cl.

CPC ..... *E21B 47/011* (2013.01); *E21B 47/122* (2013.01); *E21B 49/00* (2013.01)

(58) Field of Classification Search

CPC ..... E21B 47/011; E21B 47/122; E21B 49/00

USPC ..... 166/380

See application file for complete search history.

(56) References Cited

U.S. PATENT DOCUMENTS

| | | | | |
|---|---|---|---|---|
| 5,003,687 | A | 4/1991 | Lapp et al. | |
| 2004/0061622 | A1* | 4/2004 | Clark | E21B 47/122 340/854.6 |
| 2004/0263414 | A1 | 12/2004 | Chen et al. | |
| 2005/0219139 | A1 | 10/2005 | Kimura et al. | |
| 2006/0119364 | A1 | 6/2006 | Chen et al. | |
| 2010/0277176 | A1 | 11/2010 | Homan et al. | |

(Continued)

FOREIGN PATENT DOCUMENTS

| | | | |
|---|---|---|---|
| WO | 2013095754 | A1 | 6/2013 |

OTHER PUBLICATIONS

International Search Report and Written Opinion for PCT/US2015/056475 dated Feb. 15, 2016.

*Primary Examiner* — Taras P Bemko

(74) *Attorney, Agent, or Firm* — Alan Bryson; Tumey LLP

(57) ABSTRACT

Mechanisms for induction-based resistivity measurements can be provided for use in geo-steering in a drilling operations environment. An antenna assembly can provide effective protection for antenna sections without hindering propagation of electromagnetic signals. The antenna assembly can include a bobbin disposed about a collar of a tool string; an antenna disposed on an outer surface of the bobbin; an outer adhesive layer covering the antenna and at least a portion of the bobbin; and a protective layer disposed against the outer adhesive layer; wherein the outer adhesive layer fills a space radially between the bobbin and the protective layer.

20 Claims, 4 Drawing Sheets

(56) References Cited

U.S. PATENT DOCUMENTS

2011/0316542 A1* 12/2011 Frey ..... G01V 3/26
324/339
2012/0021196 A1* 1/2012 Kenney ..... B29C 70/34
428/213

* cited by examiner

BUILDUP AND ENCAPSULATION OF ANTENNA SECTION OF DOWNHOLE TOOL

BACKGROUND

During drilling operations for extraction of hydrocarbons, a variety of recording and transmission techniques have been attempted to provide or record real time data from the vicinity of the bit to the surface during drilling. The use of measurements while drilling (MWD) with real time data transmission provides substantial benefits during a drilling operation. For example, monitoring of downhole conditions allows for an immediate response to potential well control problems and improves mud programs.

Measurement of parameters such as location, environment, weight on bit, torque, wear, and bearing condition in real time provides for more efficient drilling operations. MWD techniques help achieve faster penetration rates, better trip planning, reduced equipment failures, fewer delays for directional surveys, and the elimination of a need to interrupt drilling for abnormal pressure detection.

Antennae, whether used for the transmission and reception of interrogating fields during logging operations or for the electromagnetic communication of data, can be delicate devices that cannot be too heavily shielded or they will not be able to perform their functions. Furthermore, antennae cannot be exposed to wellbore conditions, particularly during drilling operations, without substantial risk of harm or malfunction. Consequently, traditional antenna constructions for downhole use utilize solid wellbore tubulars, such as drill collar tubulars and drill pipe tubulars, to form a housing that protects the antenna from damage due to the corrosive fluids, high pressures, and high temperatures frequently encountered in wellbores particularly during drilling operations. Traditional techniques require that a portion of the tubular be "necked-down" during milling and/or machining operations by radially reducing the tubular at a particular location to provide a rather deep and wide groove. Typically, a layer of cushioning and electrically-insulating material is provided in the groove, and the antenna windings are wound about the tubular at the position of the groove to protect the antenna from physical damage and to allow communication of electromagnetic fields between the antenna windings and the borehole and surrounding formation. A slotted sleeve is typically provided and secured in position over the antenna windings provided within the necked-down portion of the tubular member.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure relates generally to antenna design and, more particularly, to antenna sensors and transmitters for use in a drilling operations environment.

An antenna section in a downhole logging tool can include components that are vulnerable to malfunction if not adequately protected from the downhole drilling environment. Protective structures of the present disclosure can secure electronic components in the antenna assembly and encapsulate the assembly in such a manner as to prevent any damage from downhole pressure, temperature, fluid, vibrations, and other dynamic conditions.

According to at least one embodiment, a logging tool can provide single or multiple antenna sections of same or varying dimensions. According to embodiments, an antenna section provides components of an antenna assembly that are held in place with adhesives, encapsulants, and protective layers. Layers of adhesives are utilized to install successive layers of components. An outer impervious layer of material, including a non-metallic compound, elastomers or polymers, encapsulates the components to provide protection from downhole pressure, fluid invasion, thermal effects, impact and other adverse dynamic conditions.

According to at least one embodiment, the antenna assembly can include components of an electronics assembly, windings for an antenna, layers of electrical and magnetic shielding, antenna carriers, and other components that are surrounded with impervious layers of nonconductive material. The layers are provided in a manner that limits or prevents air gaps there between. The layers are also formed to protect the antenna sections without hindering the propagation of electromagnetic signals. Accordingly, the antenna assembly can facilitate increased the range of data transmission. At the same time, the encapsulation can dampen any vibration and protect the components from harsh drilling environments.

Exemplary antenna assemblies of the subject technology can be used in a wellbore and provide protection to the antenna itself from the harsh wellbore environment without significantly interfering with the operational capabilities (e.g., sensing) of the antenna assemblies. Exemplary antenna assemblies of the subject technology provide housing and support for an antenna with a contoured portion on an outer peripheral surface of a bobbin.

Exemplary antenna assemblies can provide a measurement-while-drilling apparatus for use in drilling operations to interrogate a borehole and surrounding formation, which includes transmitting and receiving antennae that are spaced apart along a tubular member and utilized to generate and receive an interrogating electromagnetic signal. At least one antenna assembly includes an antenna disposed in an antenna pathway along a tool string and a mechanism for preferentially communicating electromagnetic energy between at least a portion of the antenna and the borehole and surrounding formation.

Figure 1:
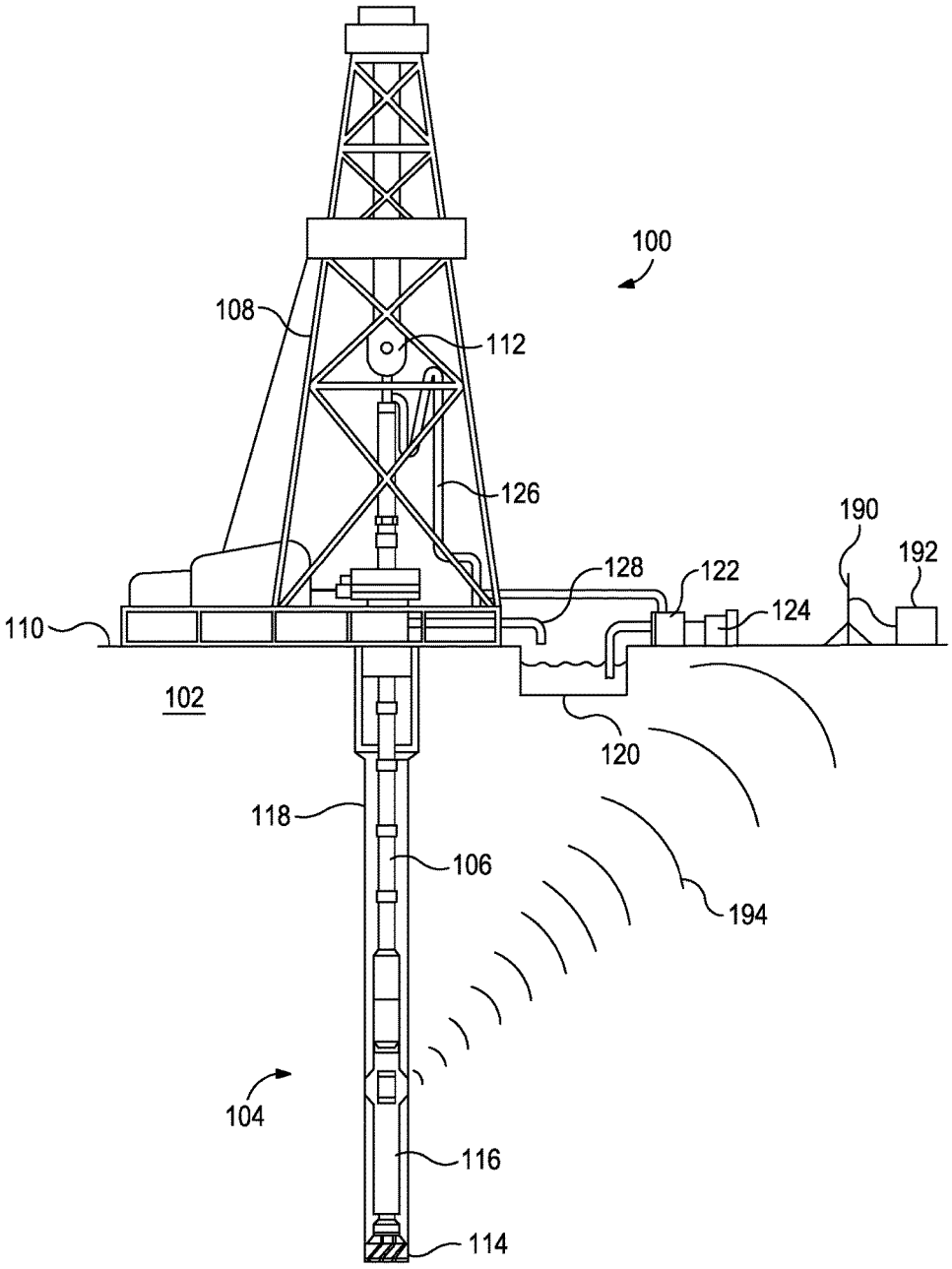
FIG. 1 shows a view of an exemplary drilling system.

Referring to FIG. 1, illustrated is an exemplary drilling system 100 that may employ one or more principles of the present disclosure. Boreholes may be created by drilling into the earth 102 using the drilling system 100. The drilling system 100 may be configured to drive a bottom hole assembly (BHA) 104 positioned or otherwise arranged at the bottom of a drill string 106 extended into the earth 102 from a derrick 108 arranged at the surface 110. The derrick 108 includes a traveling block 112 used to lower and raise the drill string 106.

The BHA 104 may include a drill bit 114 operatively coupled to a tool string 116 which may be moved axially within a drilled wellbore 118 as attached to the drill string 106. During operation, the drill bit 114 penetrates the earth 102 and thereby creates the wellbore 118. The BHA 104 provides directional control of the drill bit 114 as it advances into the earth 102. The tool string 116 can be semi-permanently mounted with various measurement tools (not shown) such as, but not limited to, measurement-while-drilling (MWD) and logging-while-drilling (LWD) tools, that may be configured to take downhole measurements of drilling conditions. In other embodiments, the measurement tools may be self-contained within the tool string 116, as shown in FIG. 1.

Fluid or "mud" from a mud tank 120 may be pumped downhole using a mud pump 122 powered by an adjacent power source, such as a prime mover or motor 124. The mud may be pumped from the mud tank 120, through a standpipe 126, which feeds the mud into the drill string 106 and conveys the same to the drill bit 114. The mud exits one or more nozzles arranged in the drill bit 114 and in the process cools the drill bit 114. After exiting the drill bit 114, the mud circulates back to the surface 110 via the annulus defined between the wellbore 118 and the drill string 106, and in the process, returns drill cuttings and debris to the surface. The cuttings and mud mixture are passed through a flow line 128 and are processed such that a cleaned mud is returned down hole through the standpipe 126 once again.

According to at least one embodiment, one or more antenna sections 150 (FIG. 2) can form a part of the BHA 104 and, more particularly, an LWD tool. The antenna sections 150 can include an electronics assembly 250 (FIG. 3) for transmitting and receiving electromagnetic signals relating to operation of the BHA 104. According to at least one embodiment, the antenna section 150 may include transceivers for communications via electromagnetic signals. The system 100 can include a remote antenna 190 coupled to a remote ground station 192. The remote antenna 190 and/or the remote ground station 192 may or may not be positioned near or on the drilling rig floor. The remote ground station 192 may communicate with the antenna section 150 wirelessly via a signal 194 using the remote antenna 190. A more detailed description of communications is set forth below.

Although the drilling system 100 is shown and described with respect to a rotary drill system in FIG. 1, those skilled in the art will readily appreciate that many types of drilling systems can be employed in carrying out embodiments of the disclosure. For instance, drills and drill rigs used in embodiments of the disclosure may be used onshore (as depicted in FIG. 1) or offshore (not shown). Offshore oilrigs that may be used in accordance with embodiments of the disclosure include, for example, floaters, fixed platforms, gravity-based structures, drill ships, semi-submersible platforms, jack-up drilling rigs, tension-leg platforms, and the like. It will be appreciated that embodiments of the disclosure can be applied to rigs ranging anywhere from small in size and portable, to bulky and permanent.

Further, although described herein with respect to oil drilling, various embodiments of the disclosure may be used in many other applications. For example, disclosed methods can be used in drilling for mineral exploration, environmental investigation, natural gas extraction, underground installation, mining operations, water wells, geothermal wells, and the like. Further, embodiments of the disclosure may be used in weight-on-packers assemblies, in running liner hangers, in running completion strings, etc., without departing from the scope of the disclosure.

Figure 2:
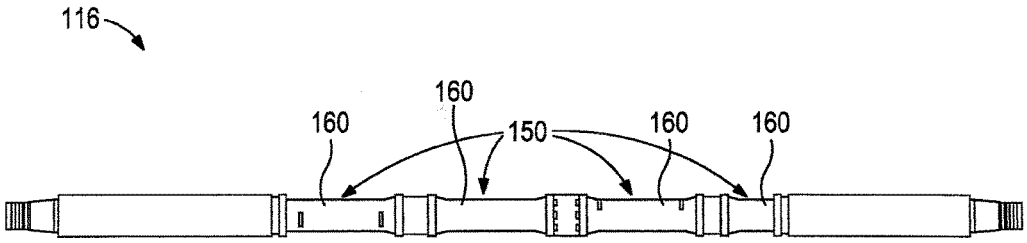
FIG. 2 shows a side view of an exemplary tool string of a drilling system.
Figure 3:
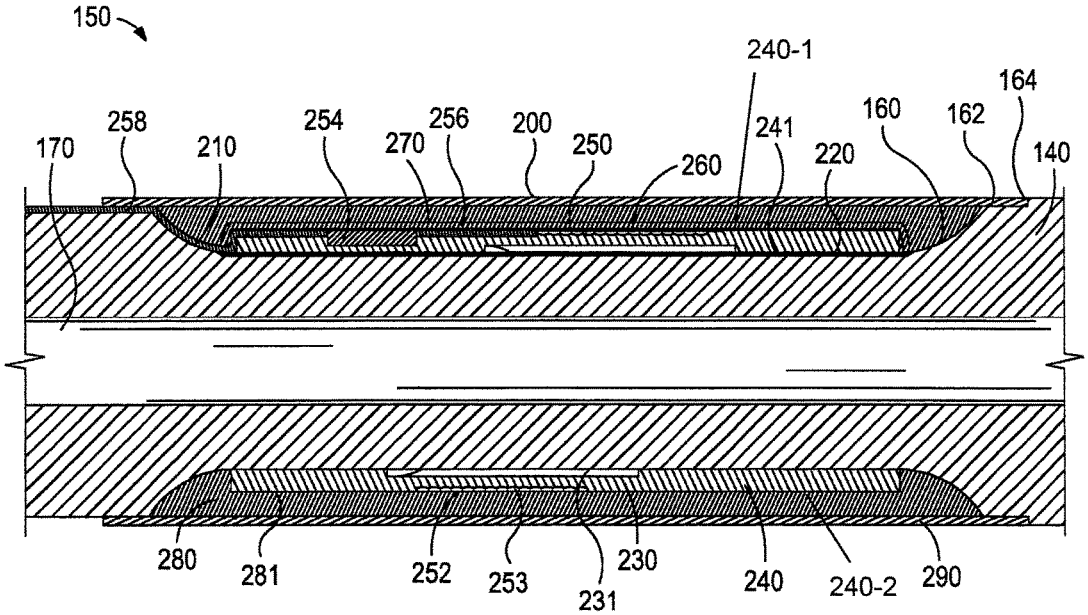
FIG. 3 shows a sectional view of an exemplary antenna section of a tool string.

According to embodiments, and as shown in FIG. 2, the drill string 106 (FIG. 1) can include an antenna section 150 or a plurality of antenna sections 150 positioned or otherwise included in the tool string 116. Each antenna section 150 can provide a collar 160 for receiving an antenna assembly 200 (FIG. 3). The antenna assembly 200 can be operated to communicate information to a base station at a location remote from the tool string 116, as described herein.

According to at least one embodiment, as shown in FIGS. 2 and 3, each collar 160 can be formed as a radially inset region on an outer surface of the tool string 116. The collar 160 can extend radially inward relative to radially outer surfaces of axially adjacent regions 140 of the tool string 116. As shown, the section defined by each collar 160 can have an outer diameter that is less than an outer diameter of other portions of the tool string 116. Within the tool string 116, a channel 170 (FIG. 3) can extend axially along or parallel with a central axis of the tool string 116.

FIG. 3 shows a sectional view of an exemplary antenna section 150 of a tool string. In the illustrated embodiment, an outer sleeve 290 is provided to house the various components of the antenna section 150. For example, the outer sleeve 290 provides a circumferential encapsulation by extending about a central axis of the tool string 116. An inner diameter of the outer sleeve 290 can be greater than an outer diameter of the collar 160, thereby defining an annular space between the collar 160 and the outer sleeve 290. Other components of the antenna section 150 can be positioned within the annular space. According to at least one embodiment, the outer sleeve 290 can be formed of a nonconductive material. For example, the outer sleeve 290 can be formed of a nonmetallic material, such as fiberglass. By further example, the outer sleeve 290 can be formed of a polymer or polymeric material, such as polyether ether ketone (PEEK). Alternatively or in combination, the outer sleeve 290 can include conductive and/or metallic materials, such as nickel-based alloys, chromium-based alloys, copper-based alloys, INCONEL®, MONEL®, fiberglass, and/or combinations thereof. Different materials or combinations of materials can be provided in multiple layers.

According to at least one embodiment, and as shown in FIG. 3, a first (e.g., downhole) end of the outer sleeve 290 may have a size and shape to engage a receiving portion 162 of the collar 160. For example, the collar 160 can provide a shoulder 164 to limit travel of the first end of the outer sleeve 290 in a downhole direction (i.e., to the right in FIG. 3). The first end of the outer sleeve 290 can connect to the collar 160 with a locking mechanism (not shown). For example, the locking mechanism can connect and secure to the collar 160 by a mechanical attachment (e.g., snap rings, latches, bolts, screws, other threaded fasteners, etc.).

According to at least one embodiment, a second (e.g., uphole) end of the outer sleeve 290 can engage to another portion of the collar 160 by another locking mechanism (not shown). For example, the second end of the outer sleeve 290 can connect and secured to the collar 160 by the same or a different mechanical attachment (e.g., with a lock ring).

According to at least one embodiment, the antenna section 150 includes a bobbin 240 for engaging the collar 160 of the tool string 116 and for radially supporting an electronics assembly 250 thereon. The bobbin 240 includes a first sidewall 240-1 and a second sidewall 240-2 opposite of the first sidewall 240-1. According to at least one embodiment, the bobbin 240 can be formed of a thermoplastic material. The bobbin 240 can be formed, for example, by 3-D printing, injection molding, or other processes.

The electronics assembly 250 can include a coil winding 252 of an antenna 253. As shown in FIG. 3, the coil winding 252 can extend wrapped about the collar 160 and extend along at least a portion of an axial length thereof. The coil winding 252 can form any number of turns or windings about the collar 160. The coil winding 252 can be concentric or eccentric relative to a central axis of the collar 160.

Figure 4A:
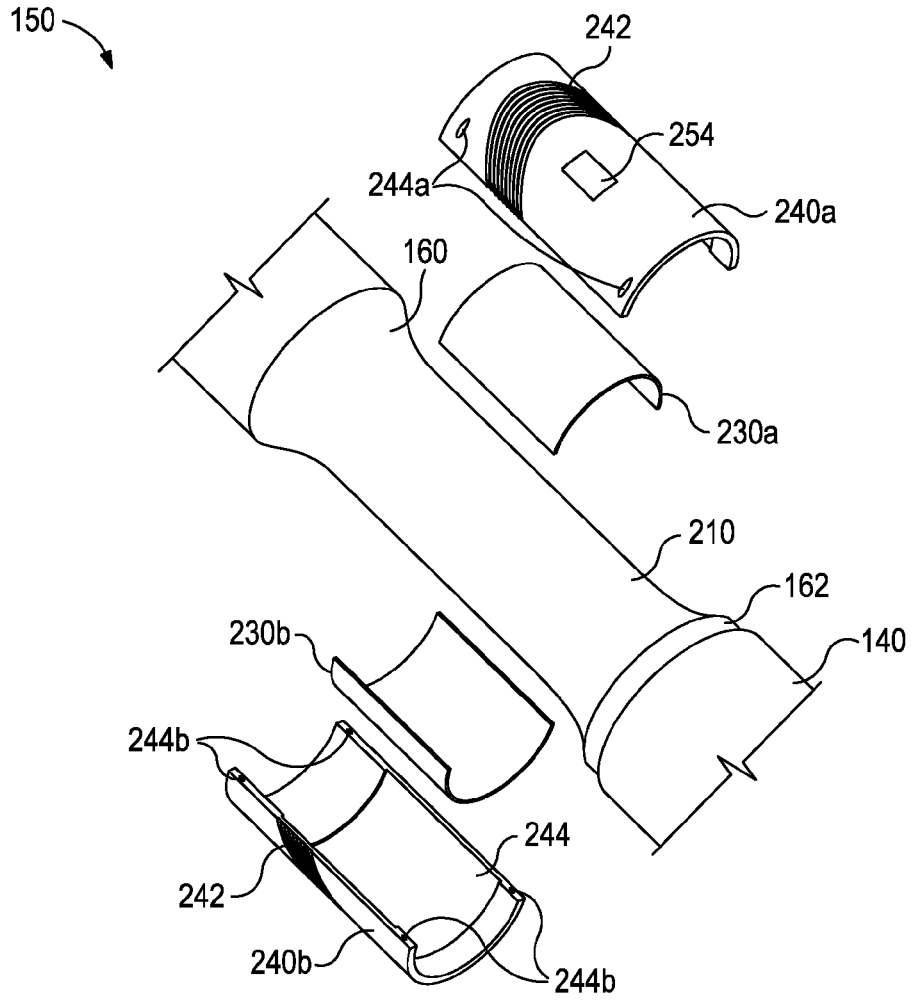
FIG. 4A shows a perspective view of an exemplary collar of a tool string with components of an antenna section at a stage of assembly.

FIG. 4A shows an exploded perspective view of an exemplary collar 160 of a tool string with components of an antenna section 150 at a stage of assembly. As illustrated, at least a portion of the coil winding 252 may be provided about at least a portion of a bobbin 240. For example, the bobbin 240 can extend axially along the collar 160 and provide an antenna region 242 to receive the coil windings 252. The antenna region 242 is a region of the bobbin 240 about which the coil windings 252 of the antenna 253 can be wrapped. The antenna region 242 of the bobbin 240 can be formed as a radially inset region on an outer surface of the bobbin 240. The antenna region 242 can extend radially inward relative to radially outer surfaces of axially adjacent regions of the bobbin 240. The antenna region 242 can include ridges, slots, channels or other structures to receive the coil windings 252. While coil windings 252 are shown to form the antenna of the electronics assembly 250, other shapes and pathways can be used to form an antenna upon the bobbin 240. Shapes and geometries for alternative antennae are known and can be applied to the electronics assembly 250 of the present disclosure.

The coil windings 252 of the antenna 253 can be oriented to transmit signals to or receive signals from a particular location with respect to the tool string 116. For example, each turn of the coil windings 252 can be substantially formed in a plane that is or is not orthogonal to the central axis of the tool string 116. According to at least one embodiment, sets of coil windings 252 from each of a plurality of antenna sections 150 can have orientations that are distinct from each other to provide broad coverage for transmitting and receiving signals.

According to at least one embodiment, the electronics assembly 250 of the antenna section 150 can include a printed circuit board ("PCB") 254 and/or other electronic components, mounted within the annular space defined by the outer sleeve 290. The PCB 254 can be provided on an outer or inner surface of the bobbin 240, or otherwise embedded therein. The PCB 254 can connect to the coil windings 252 of an antenna via an internal connection line 256. The internal connection line 256 can be provided on an outer or inner surface of the bobbin 240, or otherwise embedded therein. The PCB 254 can further connect to other systems outside of the antenna section 150 via an external connection line 258.

According to at least one embodiment, a shield 230 may be provided at least partially within at least a portion of the coil windings 252 (e.g., positioned radially inward from the coil windings 252). The shield 230 can be concentric with or otherwise radially within the coil windings 252. For example, the shield 230 can extend axially along the collar 160 and radially within a portion of the coil windings 252. A first end of the shield 230 can extend axially beyond a first end of the coil winding 252, and a second end of the shield 230 can extend axially beyond a second end of the coil winding 252. The shield 230 can be formed of a ferromagnetic material, such as iron or an iron-based alloy, to limit or prevent Eddy currents within the collar 160 that would be generated by the coil windings 252 and potentially alter the direction in which a field or signal is propagated by the coil windings 252. The shield 230 may also be formed of any soft magnetic material, such as manganese zinc (MnZn).

According to at least one embodiment, a protective layer 280 (FIG. 4C) can be formed about the bobbin 240 and the electronics assembly 250. The protective layer 280 can provide securement of the bobbin 240 and the electronics assembly 250 while permitting propagation of signals from the antenna. According to at least one embodiment, the material of the protective layer 280 can be any material that is capable of withstanding conditions during a wellbore operation. For example, the material can withstand pressure (e.g., 20 ksi or greater), temperature, and exposure to environmental component (e.g., drilling fluids, contaminants, oil and gas). A thickness of the protective layer 280 can be between about 0.1" and 0.5". For example, a thickness of the protective layer 280 can be about 0.25". The protective layer 280 can be formed of a nonconductive and/or nonmetallic material. For example, the protective layer 280 can be formed of a rubber material or other a polymers and/or polymeric materials. By further example, the protective layer 280 can be formed of a fluoropolymer elastomer (e.g., VITON®).

With reference to FIGS. 4A-4D, components of the antenna section 150 can be assembled in a manner that secures each to the collar 160 and preserves effective transmission and reception of electromagnetic signals. As shown in FIG. 4A, the collar 160 can provide a surface on which other components of the antenna section 150 can be placed.

According to at least one embodiment, a bond coating 210 is provided on at least a portion of an outer surface of the collar 160. The bond coating 210 can be provided, for example, on portions of the collar 160 that are exposed to the protective layer 280. By further example, the bond coating 210 can be provided on an entire outer surface of the collar 160. The bond coating 210 can be formed of a material that promotes adhesion of the protective layer 280 to the collar 160. For example, adhesion between the bond coating 210 and the protective layer 280 can be superior to adhesion between the protective layer 280 and the collar 160. The bond coating 210 can be formed of a nonconductive material. The bond coating 210 can include aluminum oxide, ceramics, or other nonconductive materials.

According to at least one embodiment, an adhesive may be applied to at least a portion of the collar 160 (and/or the bond coating 210). The adhesive forms an inner adhesive layer 220 (FIG. 3) between the collar 160 and the bobbin 240 and/or shield 230. The adhesive can be, for example, an epoxy, such as RTV. The adhesive can be provided as a gel or liquid on an outer surface of the collar 160. For example, as the bobbin 240 and/or the shield 230 are placed over a region of the collar 160 that includes the inner adhesive layer 220, air gaps (e.g. bubbles) can be displaced from between the collar 160 and the bobbin 240 and/or shield 230.

According to at least one embodiment, and as shown in FIG. 4A, the shield 230 can be provided as first and second shield portions 230*a* and 230*b*. Each of the first and second shield portions 230*a,b* are provided on opposite sides of the collar 160. The first and second shield portions 230*a,b* can be provided over a portion of the collar 162 to which the adhesive of the inner adhesive layer 220 has been applied. The adhesive of the inner adhesive layer 220 can be applied in greater abundance than is required to fill the space 231 between the shield 230 and the collar 160. As the first and second shield portions 230*a,b* are applied over the inner adhesive layer 220, at least a portion of the adhesive is displaced such that air gaps are limited or prevented between the collar 160 and the shield 230.

According to at least one embodiment, and as shown in FIG. 4A, the bobbin 240 can be provided as first and second bobbin portions 240*a* and 240*b*. Each of the first and second bobbin portions 240*a,b* are provided on opposite sides of the collar 160. The first and second bobbin portions 240*a,b* may be secured to each other with one or more locking mechanisms. For example, first locking mechanisms 244*a* of the first bobbin portion 240*a* can be aligned and configured to engage with second locking mechanisms 244*b* of the second bobbin portion 240*b*. The first and second locking mechanisms 244*a,b* can include fasteners, pins, latches, threaded engagements, or other structures capable of holding the first and second bobbin portions 240*a,b* to each other.

According to at least one embodiment, the first and second bobbin portions 240*a,b* can be provided over a portion of the collar 160 to which the adhesive of the inner adhesive layer 220 has been applied. An additional adhesive layer can be provided between the shield 230 and the bobbin 240. As with the shield 230, the adhesive of the inner adhesive layer 220 can be applied in greater abundance than is required to fill the space 241 radially between the bobbin 240 and the collar 160. As the first and second bobbin portions 240*a,b* are applied over the inner adhesive layer 220, at least a portion of the adhesive is displaced such that air gaps are limited or prevented between the collar 160 and the bobbin 240.

Figure 4B:
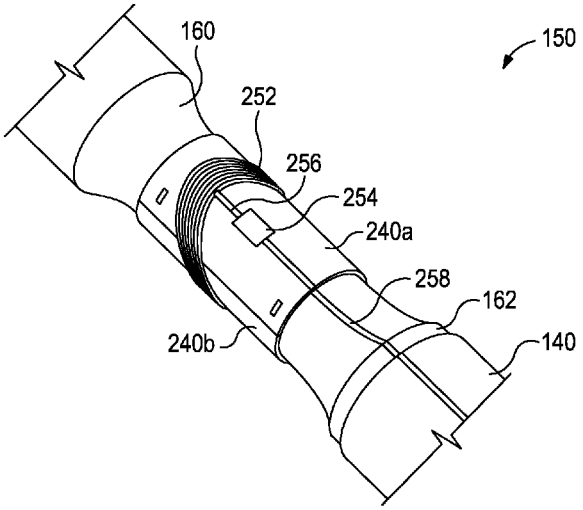
FIG. 4B shows a perspective view of an exemplary collar of a tool string with components of an antenna section at a stage of assembly.

FIG. 4B shows a perspective view of the collar 160 of the antenna section 150 in a partially assembled configuration. As illustrated, with the first and second bobbin portions 240*a,b* in place, the coil windings 252 can be provided to the antenna region 242 (FIG. 3) of the bobbin 240. Any other components of the electronics assembly 250 can be provided and/or connected after the first and second bobbin portions 240*a,b* are in place.

According to at least one embodiment, an adhesive forms an outer adhesive layer 270 (FIG. 3) between (i) the bobbin 240 and/or electronics assembly 250 and (ii) the protective layer 280. Referring back to FIG. 3, the outer adhesive layer 270 is disposed on the bobbin 240 and the inner surface of the outer adhesive layer 270 is in direct contact with the second sidewall 240-2 of the bobbin 240. The adhesive can be, for example, an epoxy, such as RTV. The adhesive can be mixed and vacuumed to remove any air bubbles, and then applied through vacuum/pressure process to an area of interest to fill/displace any air pockets between bobbin 240 and coil windings 252. Subsequently, the adhesive can be cured in an oven to set fully. After curing, the adhesive can provide a smooth layer for bonding with the protective layer 280. The outer adhesive layer 270 can be formed of the same or a different adhesive as the adhesive of the inner adhesive layer 220. The adhesive can be provided as a gel or liquid on an outer surface of the bobbin 240 and/or electronics assembly 250. For example, after the bobbin 240 and/or electronics assembly 250 are placed about the collar 160, the adhesive of the outer adhesive layer 270 is provided over an outer surface of the bobbin 240 and/or electronics assembly 250. The outer adhesive layer 270 can be formed in a manner that limits or prevents air gaps (e.g. bubbles) from between (i) the bobbin 240 and/or electronics assembly 250 and (ii) the protective layer 280. For example, the adhesive of the outer adhesive layer 270 can be applied in greater abundance than is required to fill the space 281 radially between (i) the bobbin 240 and/or electronics assembly 250 and (ii) the protective layer 280. As the protective layer 280 is applied over the outer adhesive layer 270, at least a portion of the adhesive is displaced such that air gaps are limited or prevented between (i) the bobbin 240 and/or electronics assembly 250 and (ii) the protective layer 280. An additional adhesive layer 260 can be applied to the coil windings 252 of the antenna prior to application of the outer adhesive layer 270. The adhesive of the additional adhesive layer 260 can be the same as or different from the adhesive of the outer adhesive layer 270.

Figure 4C:
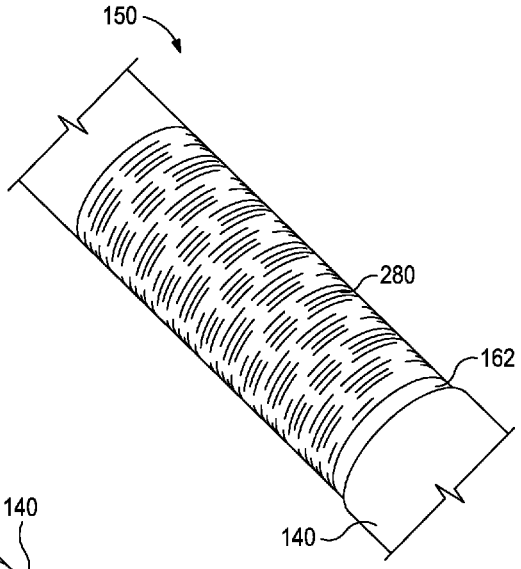
FIG. 4C shows a perspective view of an exemplary collar of a tool string with a protective layer at a stage of assembly.

FIG. 4C shows a perspective view of the collar 160 of the antenna section 150 with a protective layer 280 positioned thereon. The protective layer 280 may be formed by providing a plurality of strips over portions of the collar 160, the bobbin 240, and/or the electronics assembly 250. In particular, the protective layer 280 may be formed over the outer adhesive layer 270 (FIG. 3) that is applied to the collar 160, the bobbin 240, and/or the electronics assembly 250. Alternatively or in combination, the material of the protective layer 280 can bond to the bond coating 210 that has been applied to the collar 160. The strips forming the protective layer 280 can be applied as extending circumferentially about or axially over the collar 160, the bobbin 240, and/or the electronics assembly 250. The strips forming the protective layer 280 can be applied in segments or as a continual winding. With the strips in place, the protective layer 280 can achieve a persistent condition by applying heat and/or pressure to the strips, for example as in an autoclave process.

Figure 4D:
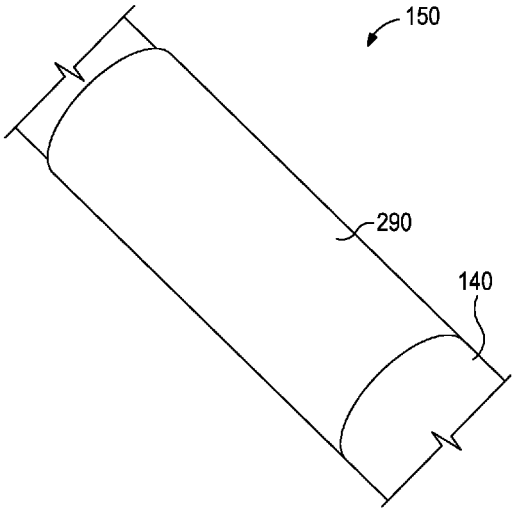
FIG. 4D shows a perspective view of an exemplary collar of a tool string with an outer sleeve at a stage of assembly.

FIG. 4D shows a perspective view of an exemplary collar of a tool string with an outer sleeve at a stage of assembly. As shown in FIG. 4D, the outer sleeve 290 is depicted as being positioned about the protective layer 280. The outer sleeve 290 can engage the receiving portion 162 (FIG. 4C) of the collar 160 and be locked thereon, as discussed herein.

According to at least one embodiment, at least a portion of the shield 230 is provided within a shield region 244 (FIG. 4D) of the bobbin 240. For example, the shield region 244 of the bobbin 240 can be formed as a radially inset region on an inner surface of the bobbin 240. The shield region 244 can extend radially outward relative to radially inner surfaces of axially adjacent regions of the bobbin 240.

According to at least one embodiment, a plurality of antenna sections 150 may cooperate together to interrogate a borehole and surrounding formation. Each antenna section 150 is operable in at least one of (1) a reception mode of operation and (2) a transmission mode of operation. In the reception mode of operation, the antenna region 242 detects electromagnetic energy in the wellbore and surrounding formation and generates a current corresponding thereto. In the transmission mode of operation, the antenna region 242 emits electromagnetic energy in the wellbore and surrounding formation in response to an energizing current.

According to at least one embodiment, information obtained by one or more antenna assemblies 200 (FIG. 3) can be recorded as operation logs for later reference by a system or user. Information obtained by one or more antenna assemblies 200 can be applied by an onboard system to manage geo-steering of the drill string 116 (FIG. 1). According to at least one embodiment, information obtained by one or more antenna assemblies 200 can be communicated to a remote system for logging or managing geo-steering of the drill string 116. According to at least one embodiment, an antenna section 150 can allow signals to pass into and out of the well during drilling operations. Communications can demonstrate performance based upon monitoring during drilling operations. Electromagnetic communication can be provided for one- or two-way communication with downhole tools. Electronic components and support structures can facilitate two-way communication with downhole tools.

For example, an electric signal 194 (FIG. 1) from the antenna section 150 can be sent to the remote ground station 192 (FIG. 1) that can include a telemetry tool. Examples of downhole tools used with the telemetry tool can include measurement while drilling (MWD) tools, pressure while drilling (PWD) tools, formation logging tools, and production monitoring tools. For example, downhole tools can include one or more sensors that provide signals corresponding to sensed conditions. The downhole tools (e.g., the antenna section 150) can include circuitry required to process such signals and transmit associated data to the surface. Based on the data received at the surface, an operator can adjust operating parameters associated with the downhole tools. For example, an operator can adjust a pressure applied by changing a fluid pressure supplied to the downhole tools.

In a signal sending operation, communications module of the electronics assembly 250 (FIG. 3), acting as a sending antenna, sends electromagnetic signals to other equipment in the wellbore and/or at the surface. Operation and data transmission by the communications module can be controlled, for example, by the PCB 254 (FIG. 3) of the electronics assembly 250. In a receiving operation, the communications module of the electronics assembly 250, acting as a receiving antenna, receive electrical signals from other equipment in the wellbore and/or at the surface. Reception by the receiving antenna and processing of receive signals can be operated, for example, by the PCB 254 of the electronics assembly 250.

One or more of a variety of communication means can be employed for wireless communication. For example, communication between the antenna section 150 and the remote ground station 192 (FIG. 1) may be formatted according to CDMA (Code Division Multiple Access) 2000 and WCDMA (Wideband CDMA) standards, a TDMA (Time Division Multiple Access) standard and a FDMA (Frequency Division Multiple Access) standard. The communication may also be formatted according to an Institute of Electrical and Electronics Engineers (IEEE) 802.11, 802.16, or 802.20 standard. The communication between the antenna section 150 and the remote ground station 192 may be based on a number of different spread spectrum techniques. The spread spectrum techniques may include frequency hopping spread spectrum (FHSS), direct sequence spread spectrum (DSSS), orthogonal frequency domain multiplexing (OFDM), or multiple-in multiple-out (MIMO) specifications (i.e., multiple antenna), for example.

Embodiments disclosed herein include:

A. An antenna assembly, comprising: a bobbin positionable about a collar of a tool string; an antenna positioned on an outer surface of the bobbin; an outer adhesive layer covering the antenna and at least a portion of the bobbin; and a protective layer about the outer adhesive layer, wherein the outer adhesive layer fills a space defined radially between the bobbin and the protective layer.

B. A tool string, comprising: a collar; a bobbin positioned about the collar; an antenna positioned on an outer surface of the bobbin; an outer adhesive layer covering the antenna and at least a portion of the bobbin; and a protective layer about the outer adhesive layer, wherein the outer adhesive layer fills a space defined radially between the bobbin and the protective layer.

C. A method of assembling an antenna assembly on a tool string, comprising: placing a bobbin about a collar of the tool string; winding an antenna about an outer surface of the bobbin; applying and outer adhesive layer to cover the antenna and at least a portion of the bobbin; applying a protective layer against the outer adhesive layer; and preventing air gaps between the protective layer and the outer adhesive layer.

Each of embodiments A, B, and C may have one or more of the following additional elements in any combination: Element 1: the antenna assembly or tool string can further include a ferromagnetic shield on an inner surface of the bobbin and radially within the antenna. Element 2: the ferromagnetic shield can be disposed within an inset shield region on an inner surface of the bobbin. Element 3: the antenna assembly or tool string can further include an inner adhesive layer radially between the bobbin and the collar. Element 4: the antenna assembly or tool string can further include an outer sleeve slidably disposed about the protective layer. Element 5: the antenna can be formed by coil windings about the bobbin. Element 6: the antenna assembly or tool string can further include electronic circuitry at the bobbin and connected to the antenna. Element 7: the antenna can be disposed within an inset antenna region on an outer surface of the bobbin. Element 8: the antenna assembly or tool string can further include a bond coating between an outer surface of the collar and an inner surface of the protective layer. Element 9: placing the bobbin about the collar includes placing first and second bobbin parts on opposite sides of the collar and securing the first bobbin part to the second bobbin part. Element 10: applying the protective layer includes placing strips of material against the outer adhesive layer while the outer adhesive layer is in a liquid or gel state.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

What is claimed is:

1. An antenna assembly, comprising:

a bobbin positionable about a collar of a tool string;

an outer sleeve positioned about an outer surface of at least a portion of the tool string, the outer sleeve having an inner diameter greater than an outer diameter of the collar to define an annular space between the collar and the outer sleeve;

an antenna positioned on an outer surface of the bobbin in the annular space;

an outer adhesive layer covering the antenna and at least a portion of the bobbin in the annular space, wherein an inner surface of the outer adhesive layer is in direct contact with at least one sidewall of the bobbin; and a protective layer positioned in the annular space and interposed between the outer sleeve and the outer adhesive layer, wherein the outer adhesive layer fills a space defined radially between the bobbin and the protective layer.

2. The antenna assembly of claim 1, further comprising a ferromagnetic shield positioned on an inner surface of the bobbin and disposed radially within the antenna.

3. The antenna assembly of claim 2, wherein the ferromagnetic shield is positioned within an inset shield region on an inner surface of the bobbin.

4. The antenna assembly of claim 1, further comprising an inner adhesive layer disposable radially between the bobbin and the collar.

5. The antenna assembly of claim 1, wherein the outer sleeve is slidably disposed about the protective layer.

6. The antenna assembly of claim 1, wherein the antenna is formed by coil windings about the bobbin.

7. The antenna assembly of claim 1, further comprising electronic circuitry at the bobbin and connected to the antenna.

8. The antenna assembly of claim 1, wherein the antenna is positioned within an inset antenna region on the outer surface of the bobbin.

9. A tool string, comprising:

a collar;

a bobbin positioned about the collar;

an outer sleeve positioned about an outer surface of at least a portion of the tool string, the outer sleeve having an inner diameter greater than an outer diameter of the collar to define an annular space between the collar and the outer sleeve;

an antenna positioned on an outer surface of the bobbin in the annular space;

an outer adhesive layer covering the antenna and at least a portion of the bobbin in the annular space, wherein an inner surface of the outer adhesive layer is in direct contact with at least one sidewall of the bobbin; and a protective layer positioned in the annular space and interposed between the outer sleeve and the outer adhesive layer, wherein the outer adhesive layer fills a space defined radially between the bobbin and the protective layer.

10. The tool string of claim 9, further comprising a ferromagnetic shield positioned on an inner surface of the bobbin and disposed radially within the antenna.

11. The tool string of claim 10, wherein the ferromagnetic shield is positioned within an inset shield region on an inner surface of the bobbin.

12. The tool string of claim 9, further comprising an inner adhesive layer disposable radially between the bobbin and the collar.

13. The tool string of claim 9, wherein the outer sleeve is slidably disposed about the protective layer.

14. The tool string of claim 9, wherein the antenna is formed by coil windings about the bobbin.

15. The tool string of claim 9, further comprising electronic circuitry at the bobbin and connected to the antenna.

16. The tool string of claim 9, wherein the antenna is positioned within an inset antenna region on the outer surface of the bobbin.

17. The tool string of claim 9, further comprising a bond coating between an outer surface of the collar and an inner surface of the protective layer.

18. A method of assembling an antenna assembly on a tool string, comprising:

placing a bobbin about a collar of the tool string;

applying an outer sleeve on an outer surface of at least a portion of the tool string, the outer sleeve having an inner diameter greater than an outer diameter of the collar to define an annular space between the collar and the outer sleeve;

winding an antenna about an outer surface of the bobbin in the annular space;

applying an outer adhesive layer to cover the antenna and at least a portion of the bobbin in the annular space, wherein an inner surface of the outer adhesive layer is in direct contact with at least one sidewall of the bobbin;

applying a protective layer against the outer adhesive layer, the protective layer being applied in the annular space and interposed between the outer sleeve and the outer adhesive layer; and preventing air gaps between the protective layer and the outer adhesive layer.

19. The method of claim 18, wherein placing the bobbin about the collar includes placing first and second bobbin parts on opposite sides of the collar and securing the first bobbin part to the second bobbin part.

20. The method of claim 18, wherein applying the protective layer includes placing strips of material against the outer adhesive layer while the outer adhesive layer is in a liquid or gel state.

* * * * *